US006283607B1

(12) United States Patent
Lin

(10) Patent No.: US 6,283,607 B1
(45) Date of Patent: Sep. 4, 2001

(54) STRUCTURE FOR ADJUSTING THE ILLUMINATING ANGLE OF LIGHTING DEVICE OF SOCKET WRENCH

(76) Inventor: Chang-Ming Lin, No. 331, Chang Chun St., Chiu Te Villiage Wu Jih Hsiang,Taichung County (TW)

( * ) Notice: Subject to any disclaimer, the term of this patent is extended or adjusted under 35 U.S.C. 154(b) by 0 days.

(21) Appl. No.: 09/528,868

(22) Filed: Mar. 20, 2000

(51) Int. Cl.[7] ..... B25B 23/18
(52) U.S. Cl. ..... 362/119; 362/120
(58) Field of Search ..... 362/119, 109, 362/110, 120, 206, 241, 265, 259, 191, 253, 394, 395, 187, 188; 81/60

(56) References Cited

U.S. PATENT DOCUMENTS 4,324,158 * 4/1982 Le Roy ..... 362/119

* cited by examiner

*Primary Examiner*—Sandra O'Shea
*Assistant Examiner*—Bao Truong
(74) *Attorney, Agent, or Firm*—Harrison & Egbert

(57) ABSTRACT

A socket wrench including a handle, a socket, and a handle body which is provided at a front end thereof with a clamping cell having a pivoting slot. The pivoting slot is provided with a guide slot and a rotary member having a shaft rod and a light bulb opening in which an illuminating element is disposed such that two pins of the illuminating element extend toward the rotary member, and that two pins are connected with two conductive annular members which are fitted over the rotary member. The conductive piece of the plug body is extended into the clamping cell by an extension guide body which is forced by a resilient element to become attached to the conductive annular member of the rotary member, thereby enabling the rotary member to adjust an angle at which the illuminating element illuminates.

3 Claims, 4 Drawing Sheets

STRUCTURE FOR ADJUSTING THE ILLUMINATING ANGLE OF LIGHTING DEVICE OF SOCKET WRENCH

FIELD OF THE INVENTION

The present invention relates generally to a socket wrench, and more particularly to a lighting device of the socket wrench, which is provided with a means to adjust the illuminating angle of the lighting device.

BACKGROUND

The socket wrench is a very handy tool which is widely used in the work shop, factory, and private home. Certain conventional socket wrenches are provided with a lighting device to facilitate the maneuvering of the socket wrench in a dark or poorly-lit place by a user of the socket wrench. However, such a conventional lighting device of the socket wrench is defective in design because the illuminating angle of the lighting device is fixed.

SUMMARY OF THE INVENTION

The primary objective of the present invention is to provide a socket wrench with a lighting device which is provided with a means to adjust the angle at which the lighting device illuminates.

The features and the advantages of the present invention will be readily understood upon a thoughtful deliberation of the following detailed description of a preferred embodiment of the present invention with reference to the accompanying drawings.

DETAILED DESCRIPTION OF THE INVENTION

Figure 1:
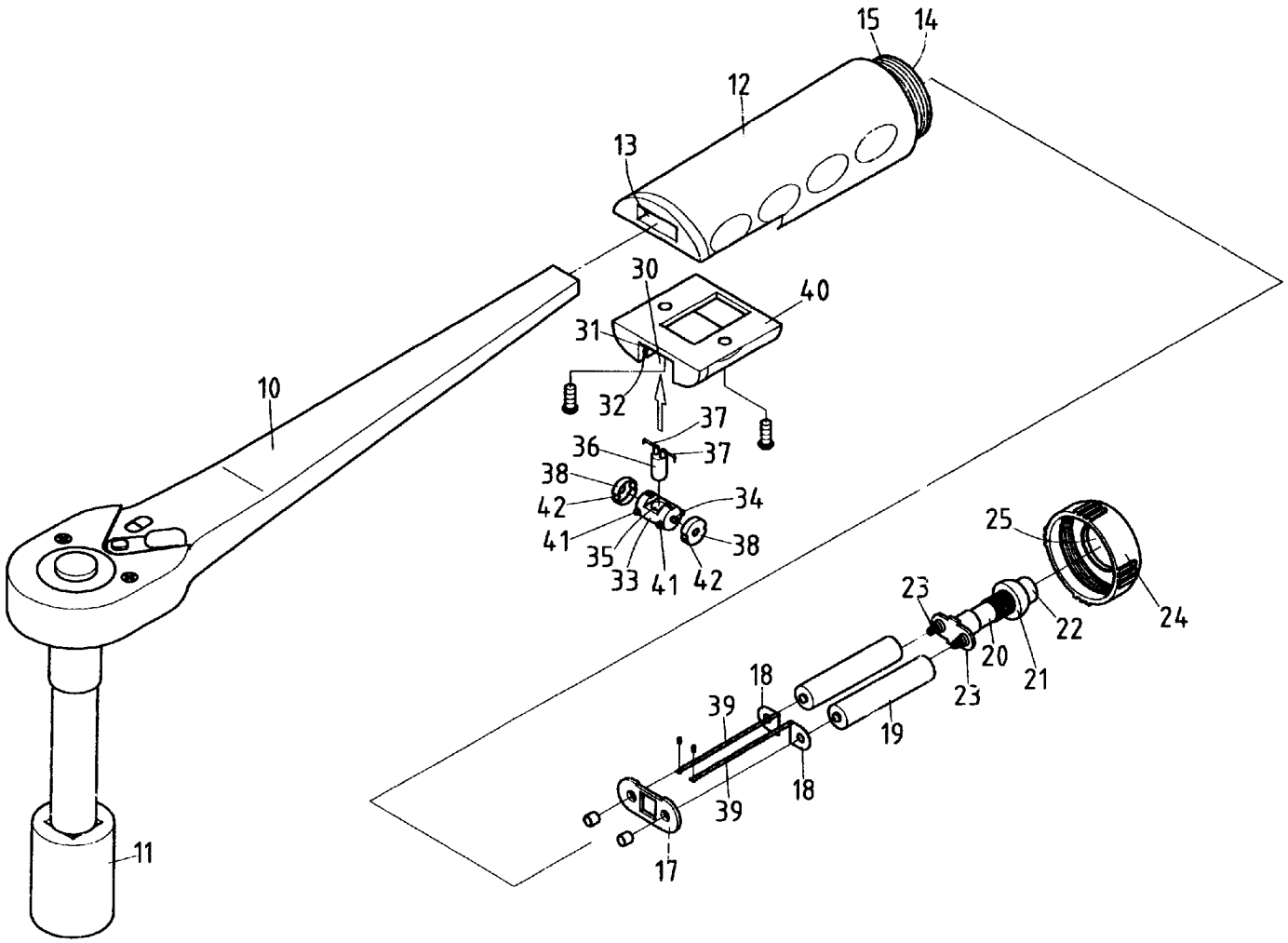
FIG. 1 shows an exploded view of the preferred embodiment of the present invention.
Figure 2:
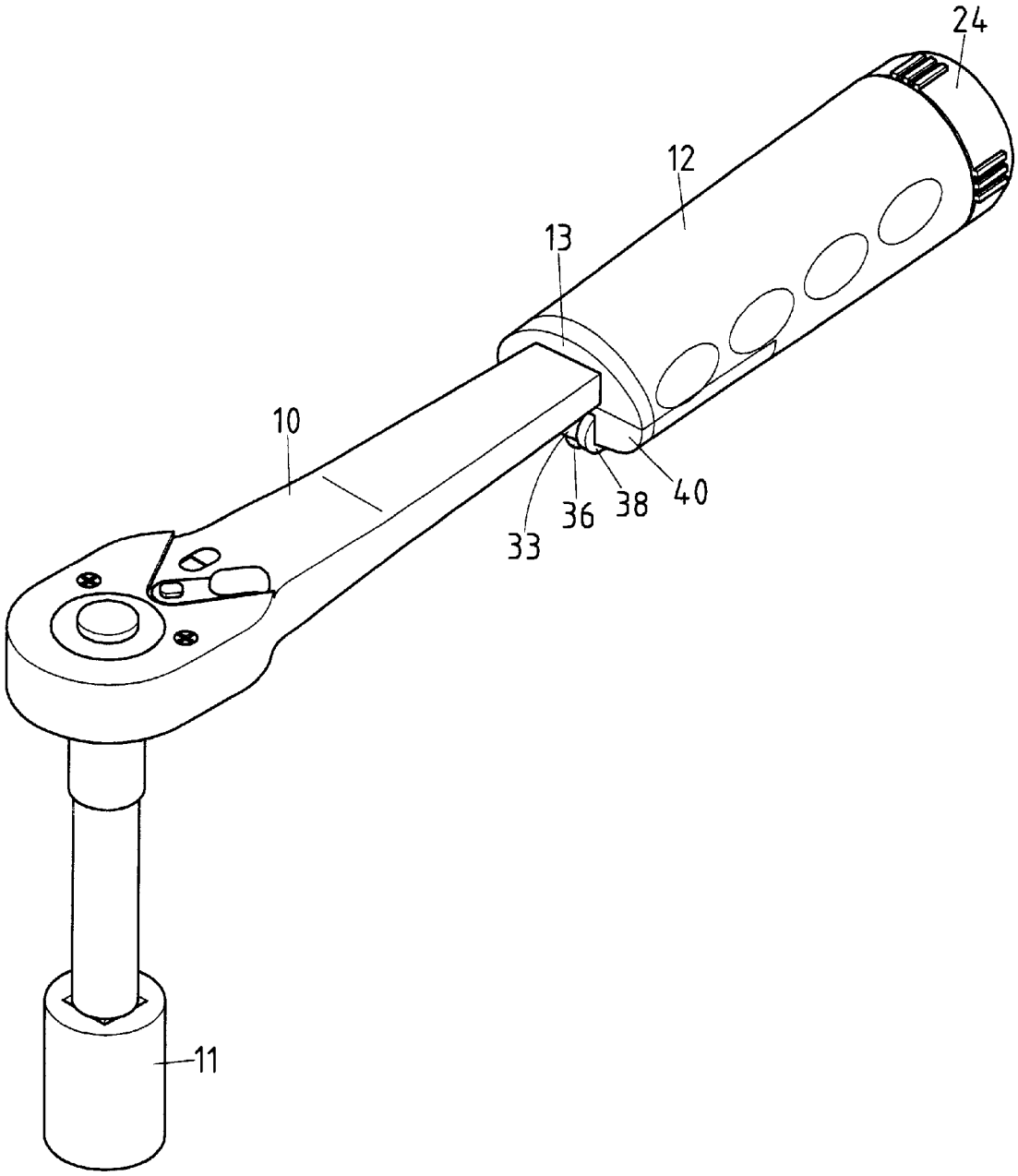
FIG. 2 shows a perspective view of the preferred embodiment of the present invention.
Figure 3:
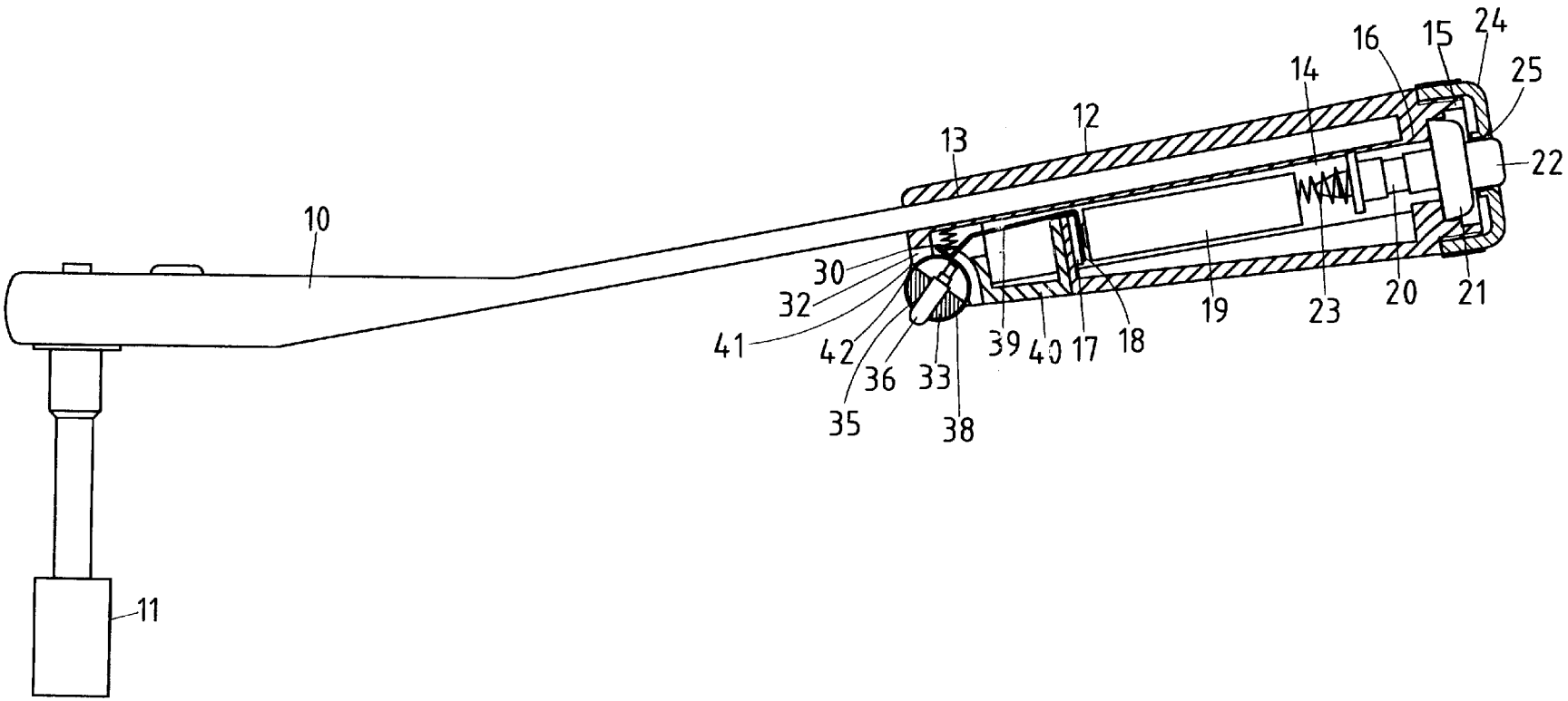
FIG. 3 shows a sectional view of the preferred embodiment of the present invention.
Figure 4:
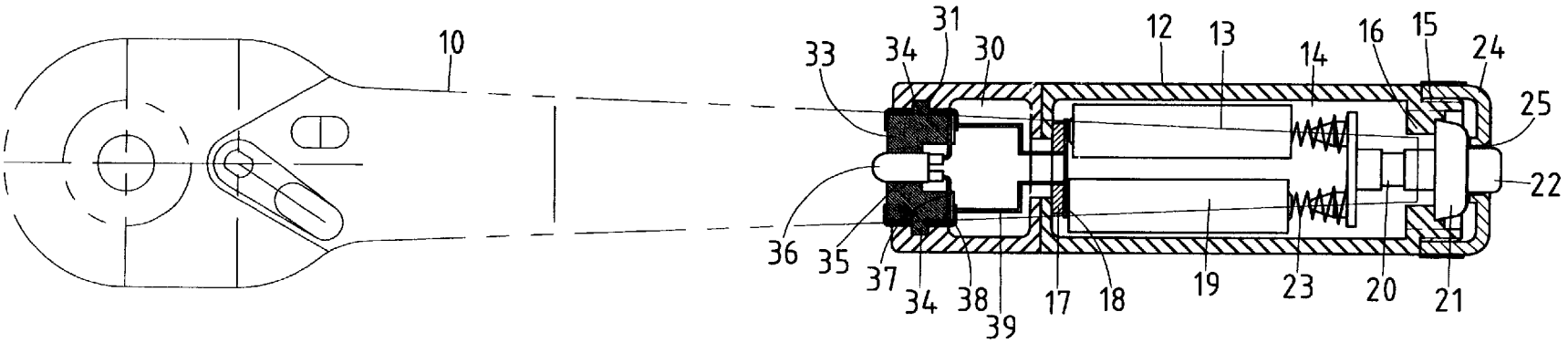
FIG. 4 shows another sectional view of the preferred embodiment of the present invention.

As shown in FIGS. 1–4, a socket wrench of the preferred embodiment of the present invention comprises a handle body 12, a socket 11, and a handle 10.

The handle body 12 is provided in one end thereof with a fastening hole 13 and in the other end thereof with a threaded portion 15 and a plug opening 14 with a shoulder 16. The plug opening 14 is provided therein with an insulated plug body 17 having a conductive piece 18, a battery set 19, and a switching element 20 having a shoulder 21, a press button 22, and a contact spring 23. The plug opening 14 is sealed off by a cap 24 having a receiving hole 25. The handle body 12 is provided at the front end thereof with a clamping cell 30 having a pivoting slot 31 which is provided with a guide slot 32 and a rotary member 33 having a shaft rod 34 and a light bulb opening 35 in which an illuminating element 36 is disposed such that the two pins 37 of the illuminating element 36 extend toward the rotary member 33, and that the two pins 37 are connected with two conductive annular members 38 which are fitted with the rotary member 33. The conductive piece 18 of the plug body 17 is extended into the clamping cell 30 by means of an extension guide body 39 which is forced by a resilient element to become attached to the conductive annular member 38 of the rotary member 33, thereby enabling the lighting angle to be adjusted.

The rotary member 33 is provided in a periphery thereof with a raised insulated top portion 41. The conductive annular member 38 is provided with a clamping mouth 42 corresponding to the raised insulated top portion 41, thereby enabling the conductive annular member 38 to be secured to the rotary member 33. The insulated top portion 41 rotates along with the rotary member 33 to urge the extension guide member 39. The clamping cell 30 may be also disposed in a shell seat 40, which is detachable fastened to the handle body 12.

The rotary member 33 of the present invention has the shaft rod 34 and the light bulb opening 35 in which the illuminating element 36 is disposed. The rotary member 33 is fitted into the conductive annular member 38 which presses against the pin 37 of the illuminating element 36. The rotary member 33 is pivoted between the pivoting slots 31 of the clamping cell 30 by the shaft rod 34. The two extension guide bodies 39 of the conductive piece 18 are extended into the clamping cell 30 to form a circuit loop. The lighting angle of the illuminating element 36 is adjusted by the rotary member 33.

What is claimed is:

1. A socket wrench comprising:

a handle;

a socket extending outwardly from said handle;

a handle body having a fastening hole formed in one end therein, said handle having an end received in said fastening hole, said handle body having a threaded portion at an opposite end thereof, said threaded portion extending around a plug opening, said plug opening having a shoulder formed interior of said handle body;

an insulated plug body received within said handle body, said plug body comprising:

a conductive piece;

a battery set having a terminal bearing against said conductive piece;

a switching element having a shoulder bearing against said shoulder of said plug opening, and a push button extending outwardly of said switching element; and a contact spring resiliently bearing against said switching element and against said battery set;

a cap threadedly affixed onto said threaded portion of said handle body, said cap having a receiving hole formed therein, said push button having a portion extending outwardly through said receiving hole; and a clamping cell affixed to said handle body adjacent said handle, said clamping cell having a pivoting slot and a guide slot formed therein, said clamping cell comprising:

a rotary member received in said guide slot, said rotary member having a shaft rod received in said pivoting slot, said rotary member having a light bulb opening formed therein;

an illuminating element disposed in said light bulb opening, said illuminating element having a pair of pins extending in opposite directions across said rotary member;

a pair of conductive annular members fitted over said shaft rod and against respective opposite ends of said rotary member, said conductive piece of said plug body extending into said clamping cell by an extension guide body resiliently urged against said prior of conductive annular member, said rotary member being pivotably so as to selectively adjust an angle of illumination by said illuminating element.

2. The socket wrench as defined in claim 1, said rotary member having a raised insulated portion formed thereon, said pair of conductive annular members each having a clamping mouth aligned with said raised insulated portion, said rotary member being pivotable such that said raised insulated portion urges said extension guide body into contact against said pair of conductive annular members.

3. The socket wrench as defined in claim 1, further comprising:

a shell seat detachable fastened to said handle body, said clamping cell being disposed in said shell seat.

* * * * *